US007546879B2

(12) United States Patent
Cantin et al.

(10) Patent No.: US 7,546,879 B2
(45) Date of Patent: Jun. 16, 2009

(54) FLOW CONTROL DEVICE

(75) Inventors: Gilles Cantin, Verrieres le buisson (FR); Vincent Tourillon, Edmonton (CA); Vincent Gergele, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/529,935

(22) PCT Filed: Oct. 9, 2003

(86) PCT No.: PCT/EP03/11250

§ 371 (c)(1),
(2), (4) Date: Dec. 19, 2005

(87) PCT Pub. No.: WO2004/101950

PCT Pub. Date: Nov. 25, 2004

(65) Prior Publication Data

US 2006/0151174 A1 Jul. 13, 2006

(30) Foreign Application Priority Data

Oct. 10, 2002 (FR) ..... 02 12590

(51) Int. Cl.
*E21B 34/00* (2006.01)

(52) U.S. Cl. ..... 166/334.4; 166/241.6; 175/325.5

(58) Field of Classification Search ..... 166/334.4, 166/334.1, 241.6, 241.7; 251/344; 175/325.5, 175/325.6, 325.7
See application file for complete search history.

(56) References Cited

U.S. PATENT DOCUMENTS

| | | | | |
|---|---|---|---|---|
| 2,594,551 | A * | 4/1952 | Gist | 166/241.7 |
| 2,944,794 | A * | 7/1960 | Myers | 175/317 |
| 4,059,293 | A * | 11/1977 | Sipler | 285/236 |
| 6,325,150 | B1 * | 12/2001 | Rayssiguier | 166/334.4 |
| 6,328,112 | B1 * | 12/2001 | Malone | 166/386 |
| 6,371,208 | B1 * | 4/2002 | Norman et al. | 166/334.4 |
| 6,491,097 | B1 * | 12/2002 | Oneal et al. | 166/278 |
| 6,668,935 | B1 * | 12/2003 | McLoughlin et al. | 166/375 |

FOREIGN PATENT DOCUMENTS

| | | |
|---|---|---|
| EP | 1081330 A | 3/2001 |
| FR | 2790509 A | 9/2000 |

* cited by examiner

*Primary Examiner*—Jennifer H Gay
*Assistant Examiner*—Cathleen R Hutchins
(74) *Attorney, Agent, or Firm*—Darla P. Fonseca; Jaime Castano; Dale Gaudier

(57) ABSTRACT

The invention relates to a device for control of the flow through a production tube placed in an oil well. The device comprising a portion of the production tube provided with through orifices and protection equipment for providing resistance to wear by erosion. The protection equipment comprises several add-on sectors assembled around the portion of the tube. Each add-on sector provided with an associated inner stiffener penetrating into the portion of the production tube through at least one through orifice. At least one of the add-on sectors provided with at least one opening extending through the sector and its associated inner stiffener.

13 Claims, 4 Drawing Sheets

FIG. 4 a
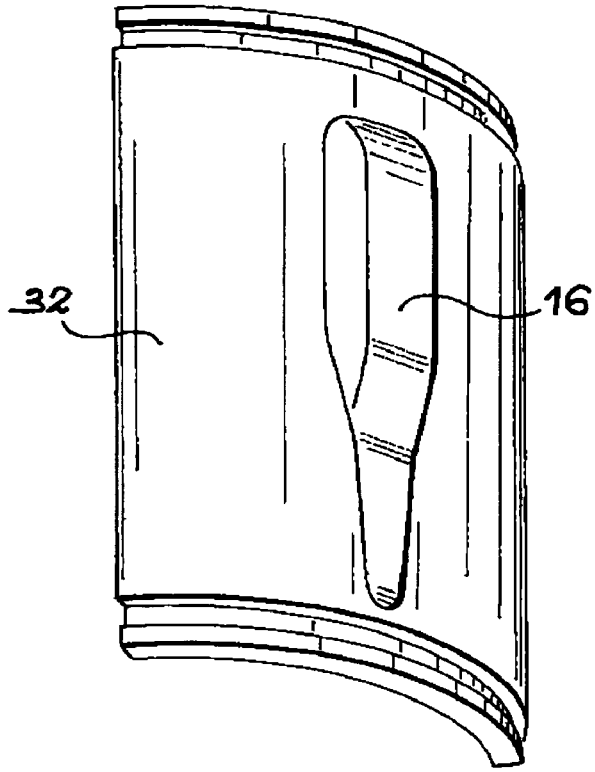
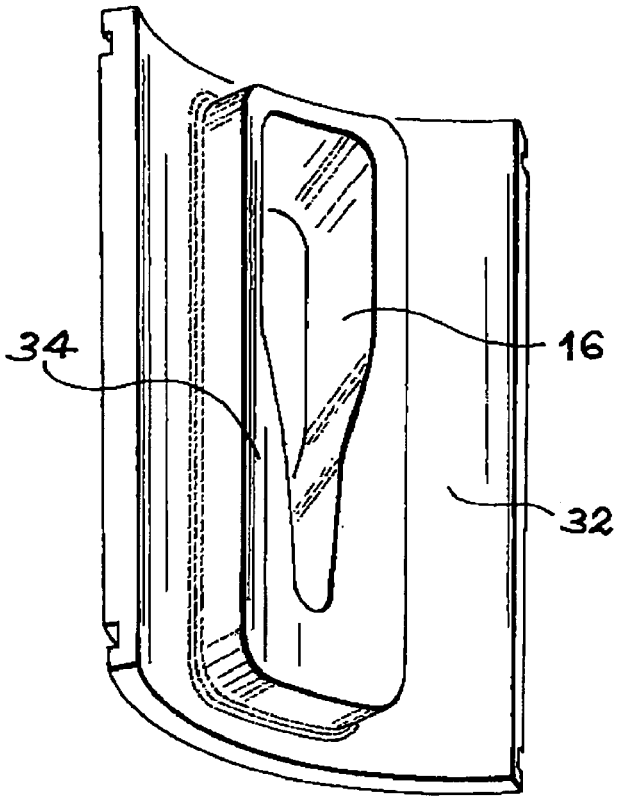
FIG. 4 b

FLOW CONTROL DEVICE

TECHNICAL FIELD

The invention is related to a device designed to permit the flow of a fluid through a production tube in an oil well or the like.

Such devices may be used in a well to optimize production or injection of fluids from or into the well as a function of time. It is particularly applicable to wells in which the fluid enters the well at a number of different locations along its length.

Various implementations of flow control devices or valves have already been proposed in the domain of oil wells or the like.

STATE OF THE PRIOR ART

One such device is described in document FR-A-2 790 509, comprises holes formed in a production tube, and a closure sleeve installed on the outside of the production tube and free to slide in front of each hole formed so as to control the flow therethrough. In this manner, the fluid flow passing through the production tube is adjusted by controlling the closure sleeve which allows only a limited amount of fluid to pass therethrough either from the underground formation to the surface, or vice versa, depending on the exact function of the well.

However, one major problem with this type of flow control device is that of erosion of the tube around the holes due to the presence of solids (sand) in the produced fluids, to the extent that the valve can lose the ability to control flow effectively and ultimately to fail completely.

Although the entire production tube may be degraded due to wear caused by passage of the fluid, certain localized parts are subject to more severe wear and deterioration. In particular, this is the case at the contours around holes through which fluid passes, which are subject to wear and damage causing a malfunction of the flow control device. Wear of these contours by erosion may be harmful for the precision of the control device, since these imprecisions can make it possible for flow variations to arise independently of variations caused by control of the relative position of the closing sleeve and the passage holes.

In order to overcome this problem, it has been proposed to create a protective envelope extending all around the outer surface of the portion of the production tube comprising holes for passage of fluid, in order to increase the life of this portion of the tube and at the same time to reduce the inaccuracies caused by wear due to erosion.

Although the technological solution proposed and mentioned above has led to relative improvements to the life of the portion of the production tube provided with the protective envelope, it was quickly realized that this technique provided insufficient protection for a device with suitable resistance to wear by erosion. The simple fact of providing a protective envelope around the outer surface of the portion of the production tube does not provide any protection against wear by erosion of the inner surface of the fluid passage holes. Experiments carried out have shown that this weakness can also cause equipment deterioration due to erosion, and thus encourage the appearance of inaccuracies in the fluid flow control.

Thus, to overcome this disadvantage, an insert solution was presented consisting of inserting a ring with high resistance to wear by erosion, inside each of the cylindrical passage holes. In this solution, the ring only extends partially into the passage hole, but it preferably extends sufficiently to protect the entire inner surface of the hole. In particular, this technique is described in document FR-A-2 790 509, in which the device comprises ceramic rings at the entry to each passage hole in order to reduce wear by erosion caused by circulation of the fluid not only around the contours of the passage holes, but also around part of the inner surface of these passage holes.

The protective ceramic rings on the inside of the cylindrical shaped passage holes can easily be inserted due to the geometry of the different elements used. Nevertheless, force fitting of this assembly is not easy for all types of protection inserts, and particularly for inserts with a complex geometrical shape. The shape of passage holes of devices for control of the flow through a production tube placed at the bottom of an oil well is very variable, and is in no way limited to a simple cylindrical shape. Consequently, when the shapes of passage holes are complex, techniques known in prior art do not propose any high performance means of protecting the inside of fluid passage holes against wear by erosion.

SUMMARY OF THE INVENTION

The present invention provides a device for control of the flow through a production tube placed in an oil well, at least partially overcoming the disadvantages with embodiments according to prior art mentioned above.

More precisely, the invention provides a flow control device in which the portion of the production tube is provided with means of protection against wear by erosion acting not only around the contours of the openings but also at the inner surface of the openings, the protection means easily being adapted to the portion of the tube regardless of the required geometric shape of these openings.

A device according to the invention comprises a portion of the production tube provided with through orifices and means of providing the device with resistance to wear by erosion, the device also comprising a sliding sleeve that can be controlled to adjust the flow. According to the invention, the protection means comprise several add-on sectors assembled around the portion of the tube, each add-on sector being provided with an associated inner stiffener penetrating into the portion of the production tube through at least one through orifice, at least one of the add-on sectors being provided with at least one opening extending through the sector and its associated inner stiffener.

Advantageously, the control device according to the invention is provided with very high performance means of protection against wear by erosion, to the extent that the contours of the openings through which the fluid circulates are composed of protective add-on sectors, and also due to the presence of inner stiffeners matching the inner surface of through orifices formed on the portion of the production tube, consequently preventing contact between the fluid and these through orifices.

The ease of assembly of the protection means on the portion of the tube can be entirely independent of the geometric shape of the openings, unlike embodiments according to prior art. The inner stiffeners housed on the inside of the through orifices can be fixed to the add-on sectors, themselves assembled around the portion of the production tube. In this way, the technological solution adopted would not require any force fitting of the inner stiffeners into the through orifices, since these stiffeners are held in place by the attachment of the sectors onto the outer surface of the portion of the tube.

The openings through which the fluid passes can then be formed through add-on protection sectors and their associated inner stiffeners, and no longer in the portion of the production tube. This specific characteristic provides the possibility of choosing a very wide variety of opening shapes, without any constraints with regard to the fixation of the anti-erosion protection on the portion of the production tube.

Another advantage of the device according to the invention relates to the possibility of simply and quickly modifying the shape of openings, by replacing the add-on sectors by other sectors with different opening shapes, without making any modification to the through orifices in the portion of the production tube formed initially.

The protection against wear by erosion achieved by using protection means can be just as efficient when the fluid flows from the surface towards the bottom of the well as when the fluid flows from the bottom of the well to the surface.

Preferably, the add-on sectors form a protective envelope around the outer surface of the portion of the production tube to prevent any contact between the portion of the production tube and the fluid causing wear by erosion, to further increase protection of the outer surface of the portion of the tube and more particularly the contours of the openings.

Furthermore, the use of two clamping rings around the portion of the production tube to fix the add-on sectors onto the portion of the production tube can facilitate assembly and disassembly of such a device. In order to cooperate with these clamping rings, each add-on sector may comprise an upper groove and a lower groove located at its upper end and its lower end respectively. In this case, the upper groove and lower groove are then capable of being fitted with an upper clamping ring and a lower clamping ring respectively.

Preferably, the sliding sleeve is capable of sliding on the add-on sectors in order to close off several openings that may be of different shapes, in the required manner.

Each add-on sector and its associated inner stiffener can be superposed and each can have approximately the shape of an annular portion, particularly to facilitate cooperation of the add-on sectors with the sliding closing sleeve. Furthermore, the shape of the inner stiffener of each add-on sector matches the shape of the through orifice in which it is located, so as to obtain a continuous internal surface of the portion of the production tube.

According to a preferred embodiment of this invention, the inner stiffener of each add-on sector is provided with a seal that fits on the internal wall of the through orifice in which it is located. In this manner, fluid cannot pass between the through orifices and the inner stiffeners, which has the effect of significantly increasing the precision of the flow control, and eliminating any pressure loss between these different elements. Furthermore, the seals provided enable the add-on sectors to be firmly fixed in the through orifices, considerably reducing vibrations of these sectors, and shocks between the sectors and the inner surface of the through orifices.

Preferably, each add-on sector is made from tungsten or a ceramic.

It is possible that the device will include several sets of sectors each with different openings.

Other advantages and characteristics of the invention will become clear in the non-limitative description given below.

BRIEF DESCRIPTION OF THE DRAWINGS

This description will be made with reference to the attached drawings among which:

FIGS. 4*a* and 4*b* show perspective views taken from different angles, of an add-on sector provided with its associated inner stiffener, according to another preferred embodiment.

DETAILED DESCRIPTION OF PREFERRED EMBODIMENTS

Figure 1:
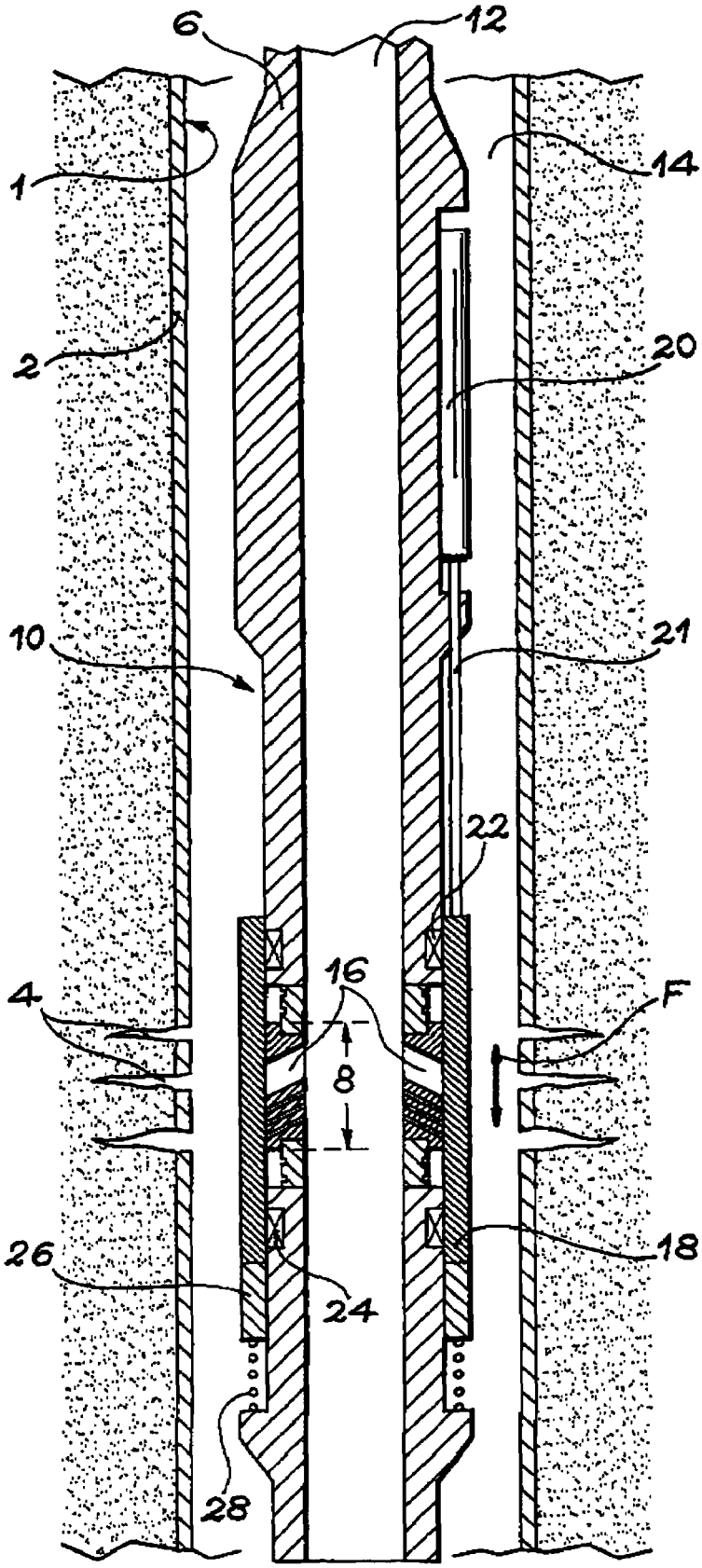
FIG. 1 shows a diagrammatic sectional view of an oil well inside which a production tube is placed, fitted with its flow control device according to a preferred embodiment of the invention.

FIG. 1 shows an oil well in production, in which only a lower region is shown. This bottom region may be oriented vertically, as shown, horizontally inclined. If the flow control device is placed in a horizontal or inclined region of the well, expressions such as "downwards" and "upwards" used in the following description should be taken to mean "in the direction away from the surface" and "in the direction towards the surface" respectively.

The walls of the well 1 are reinforced by a casing 2. In the region of the well shown in FIG. 1, the casing 2 is provided with perforations 4 to provide a communication path between the inside of the well 1 and the underground formation having fluids therein (not shown).

To enable the fluid to be transferred to the surface, a production tube 6 is inserted coaxially over the full height of the well 1. The protection tube 6 is composed of a number of tube segments connected end to end. Part of the flow control device 10 is made on a portion 8 of one of these production tube segments 6. Furthermore, in the rest of this description, the segment on which the flow control device 10 is located will in general be called the "production tube 6".

The production tube 6 defines a duct 12 on the inside, through which the fluid rises to the surface. The annular space 14 delimited between the casing 2 and the production tube 6 is closed, on each side of the flow control device 10, by annular sealing systems (packers, not shown). Thus, the only way in which the fluid from the natural deposit that passes through the perforations 14 into the well 1 can rise to the surface through the central duct 12 is to pass through the flow control device 10.

The device 10 comprises at least one opening 16 at the portion 8 of the production tube 6 (several of these openings are shown diagrammatically in FIG. 1), these openings 16 opening up on the inside of the portion 8 of the tube 6 in the duct 12, and also in well 1 at the annular space 14. The openings 16 are preferably inclined such that part of an opening 16 opening into channel 12 is higher than the part opening up into the annular space 14 in the same opening. The flow control device 10 also comprises a sliding closing sleeve 18, and control means 20 for this sleeve 18 connected to it through a rod 21. In practice, the flow control device 10 is provided with an arbitrary number of openings 16, uniformly or non-uniformly distributed around the portion 8 of the production tube 6.

The closing sliding sleeve 18 is installed on the production tube 6, so as to be able to move along a direction parallel to the axis of the production tube 6 shown by the arrow F. In this way, the closing sleeve 18 can occupy a low or front position shown in FIG. 1, corresponding to a position in which the flow control device 10 is closed. In the same way, the closing sleeve 18 may occupy a high or back position (not shown) corresponding to a position in which the device 10 is fully open, enabling maximum flow of fluid. Obviously, between these two extreme positions, the protective sleeve 18 may be moved continuously to vary the passage cross-section of the control device 10 at will, and consequently the flow of petroleum fluid passing through the portion 8 of the production tube 6.

As can be seen in FIG. 1, that the production sleeve 18 is installed outside the production tube 6. Due to the outside position of the sleeve 18, the production tube 6 is fitted with dynamic seals 22, 24 fitted in annular grooves formed on the outer surface of tube 6, the seals 22, 24 being located above and below the portion 8 of the production tube 6 respectively, so as to cooperate with the inner surface of the closing sleeve 18 while forming a sealed joint. The flow control device 10 comprises a protective sleeve 26 below the closing sleeve 18 and colinear with it. The main function of this protective sleeve 26 is to continuously overlap the seal 24 when the closing sleeve 18 moves upwards, in other words when the control means 20 are activated in the direction to open the device 10. Nevertheless, the flow control device 10 is designed such that when the protective sleeve is in the high position, it covers the seal 24 without closing the openings 16 of the device 10. This control device 10 is provided with return means designed and arranged so as to automatically bring the protective sleeve 26 into a position at which it overlaps the seal 24 when the seal 24 does not cooperate with the closing sleeve 18.

The design of the closing sleeve 18, and the design of the various means that have been described above and that enable its operation, can be adapted as a function of conditions encountered. The different elements described are simply presented as examples of particular embodiments.

Figure 2:
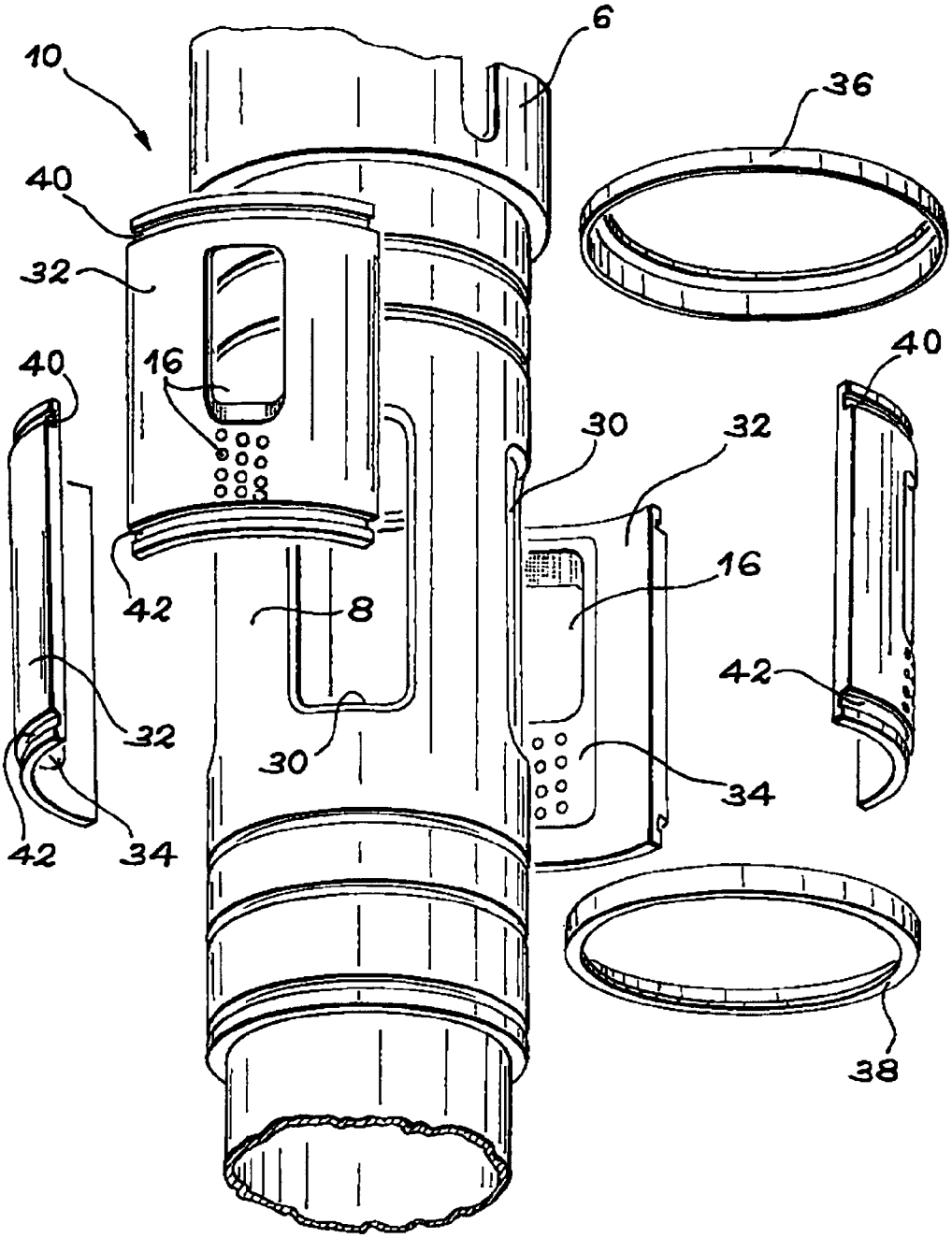
FIG. 2 shows an enlarged perspective, partially exploded view of a part of the flow control device shown in FIG. 1.

According to the invention and with reference to FIG. 2, the flow control device 10 comprises the portion 8 of the production tube 6 in which several through orifices 30 are formed. In the preferred embodiment described, the device 10 is provided with four through orifices 30 uniformly distributed around the portion 8 of the tube 6. The flow control device 10 also comprises protection means 32, 34 each with resistance to wear by erosion. The protection means 32, 34 include several add-on sectors 32 assembled around the portion 8 of the tube 6, preferably forming a protective envelope around the outer surface of this portion 8. The protection means 32, 34 are also provided with inner stiffeners 34 associated with add-on sectors 32, each of the stiffeners 34 being fixed to an add-on sector 32. When the add-on sectors 32 are in place around the portion 8 of the tube 6, each associated inner stiffener 34 penetrates into the portion 8 through at least one through orifice 30, and preferably through only one of these orifices 30. At least one of the add-on sectors 32 should comprise at least one opening 16, this opening 16 extending through the sector 32 concerned and its associated inner stiffener 34. Preferably, each sector 32 assembled on the portion 8 of the tube 6 is provided with the same opening 16, or the same openings network 16. As a result, fluid between the production tube 6 and the oil well 1 passes through the openings 16 provided directly on the protection means 32, 34.

Protection means 32, 34 on portion 8 of the tube 6 are assembled using the upper clamping ring 36, and the lower clamping ring 38 placed around portion 8 respectively, each of them cooperating with the add-on sectors 32. Each add-on sector 32 is preferably provided with an upper groove 40 in which the upper clamping ring 36 can be housed, together with a lower groove 42 in which the lower clamping ring 38 may be housed. To obtain a good quality assembly, the upper groove 40 and the lower groove 42 are located at the upper and lower ends respectively of the add-on sectors 32. (Note that the "upper and lower ends of the add-on sectors 32" refers to the end of each add-on sector 32 closest to the top and closest to the bottom of the well 1 respectively, when these sectors 32 are assembled on the portion 8 of the production tube 6.) Consequently, the selected assembly technique enables a large diversity in the choice of the geometric shape of the openings 16, to the extent that the associated inner stiffeners 34 in which these openings 16 are formed must not necessarily be force fitted into the orifices 30. The associated inner stiffeners 34 are held in place on the portion 8 by means of the attachment of the add-on sectors 32 around this portion 8, without it being necessary to use rigid links between these stiffeners 34 and the through orifices 30. Furthermore, as an example, the associated inner stiffeners 34 will preferably be free to slide in the orifices 30 easily as they are put into place. With this arrangement, it is then possible to require that each add-on sector 32 should comprise several openings 16 with different shapes such as cylindrical or an approximately parallelepiped shape. Thus, regardless of the shape of these openings 16, there is the same ease of fixing protection means 32, 34 on portion 8 of tube 6, this facility being obtained by means of clamping rings 36, 38.

Figure 3A:
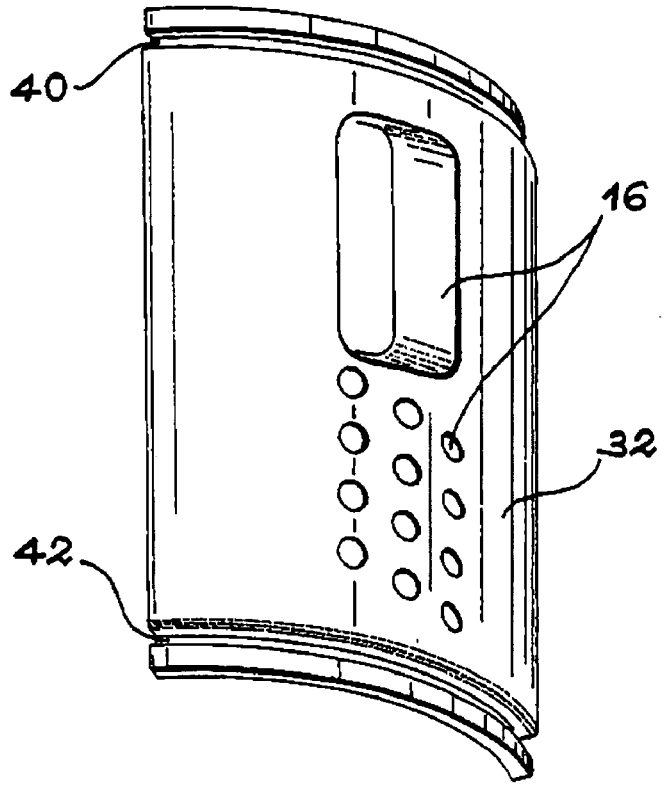
FIGS. 3*a* and 3*b* show perspective views taken from different angles of an add-on sector fitted with its associated inner stiffener, used in the flow control device shown in FIG. 2.
Figure 3B:
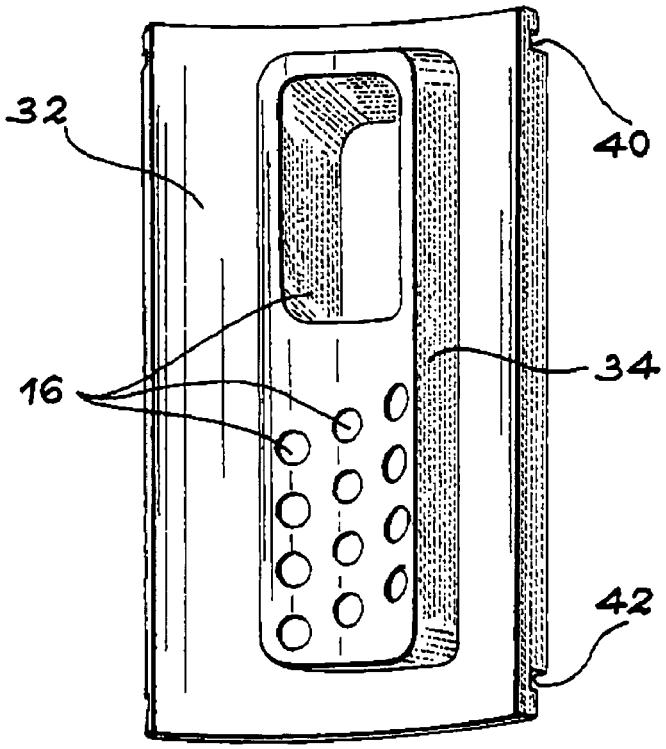

For example, FIGS. 3*a* and 3*b* show an add-on sector 32 provided with its associated inner stiffener 34. Several openings 16 are provided, including one relatively large opening with an approximately parallelepiped shape, and other smaller openings with a cylindrical shape, used particularly to achieve precise control of low flows.

Also as an example, FIGS. 4*a* and 4*b* illustrate another type of add-on sector 32 with its associated inner stiffener 34, for which the external geometry is exactly the same as the external geometry of the sector 32 and the stiffener 34 in FIGS. 3*a* and 3*b*. However, only one opening 16 is formed in this sector 32, this single opening having an approximately parallelepiped shape and gradually getting smaller at one of its ends, always in order to obtain good precision for the control of small flows. The fact that the external geometry of the sectors 32 and the stiffeners 34 is identical means firstly that these elements can be fixed on the portion 8 identically regardless of the shape of the openings 16 formed, and also that it is possible to change the add-on sectors 32 without making any changes at the through orifices 30 of the portion 8 of the tube 6.

Thus, the flow control device 10 may include several sets of add-on sectors 32, each set having different shape openings corresponding to a given flow variation mode. Consequently, depending on the needs encountered, operators can choose the most appropriate set of sectors 32 for the required flow variation through the production tube 6, without worrying about the ease of attachment of the protection means 32, 34 that is always identical. Preferably, the add-on sectors 32 in each set of add-on sectors 32 all have the same opening(s) 16.

As can be seen in FIGS. 3*a*, 3*b*, 4*a*, 4*b*, an add-on sector 32 and its associated inner stiffener 34 are superposed and are approximately in the shape of an annular portion. In this way, the outer cylindrical surface of the add-on sectors 32 is quite suitable to enable sliding of the closing sliding sleeve 18, itself preferably being provided with a cylindrical inner surface complementary to the cylindrical outer surface of the sectors 32. Furthermore, the shape of the inner stiffener 34 of each add-on sector 32 is approximately complementary to the shape of the through orifice 30 in which it is located. This specific characteristic means that the portion 8 of the production tube 6 can have a continuous internal surface, thus avoiding the need to create pressure losses in the duct 12 in the production tube 6. The fact that the inner stiffener 34 extends over the entire length of the through orifice 30 results in excellent protection against wear by erosion when the production tube 6 is designed to operate such that the fluid passes through it from top to bottom, and therefore from the ground surface towards the bottom of the well 1.

Apart from the matching shapes as mentioned above, in one preferred embodiment of the invention, the inner stiffener 34 of each add-on sector 32 is provided with a seal (not shown) designed to come into contact with the internal wall of the through orifice 30 in which it is located.

The protection means 32, 34, consisting of the add-on sectors 32 and their associated inner stiffeners 34, are preferably made from a material such as tungsten or ceramic, or any other hard material with high resistance to wear by erosion. It is then possible to make an add-on sector 32 and its associated inner stiffener 34 in a single piece, and machining operations are carried out on this piece to make the openings 16.

Obviously, those skilled in the art could make various modifications to the flow control device 10 that has just been described as a non-restrictive example only.

The invention claimed is:

1. A device for control of the flow through a production tube placed in an oil well, the device comprising a portion of the production tube provided with through orifices and a protection system comprising several add-on sectors assembled in a clamped arrangement to form a protective envelope surrounding the tube, each add-on sector being provided with an associated inner stiffener penetrating into the portion of the production tube through at least one through orifice, at least one of the add-on sectors being provided with at least one opening extending through the sector and its associated inner stiffener; said protection system providing the device with resistance to wear by erosion, the device also comprising a sliding sleeve that can be controlled to adjust the flow.

2. The device of claim 1, wherein the protective envelope surrounding the tube is around an external surface of the said portion of the production tube.

3. The device of claim 1, wherein the add-on sectors are fixed onto the said portion of the production tube by two clamping rings provided around the said portion of the production tube.

4. The device of claim 1, wherein each add-on sector comprises an upper groove and a lower groove located at its upper end and its lower end respectively, the upper groove and the lower groove being designed to hold an upper clamping ring and a lower clamping ring, respectively.

5. The device of claim 1, wherein the sliding sleeve is capable of sliding on the add-on sectors in order to close the openings in a known manner.

6. The device of claim 1, wherein each add-on sector comprises several openings with different shapes.

7. The device of claim 1, wherein each add-on sector and its associated inner stiffener are superposed and each is approximately in a shape of an annular portion.

8. The device of claim 1, wherein a shape of the inner stiffener of each add-on sector is approximately complementary to a shape of the through orifice in which the inner stiffener is located.

9. The device of claim 1, wherein each add-on sector is made from a material selected from group consisting of tungsten and ceramic.

10. The device of claim 1, wherein the device comprises several sets of sectors, each set having different openings.

11. A device for control of the flow through a production tube placed in an oil well, the device comprising a portion of the production tube provided with through orifices and a protection system comprising several add-on sectors assembled around the portion of the tube, each add-on sector being provided with an associated inner stiffener penetrating into the portion of the production tube through at least one through orifice, at least one of the add-on sectors being provided with at least one opening extending through the sector and the associated inner stiffener; said protection system providing the device with resistance to wear by erosion, the device also comprising a sliding sleeve that can be controlled to adjust the flow; and said protection system having a clamping arrangement for clamping said add-on sectors to the tube independent of a geometric shape of the through orifices of the tube.

12. A device for control of the flow through a production tube placed in an oil well, the device comprising a portion of the production tube provided with through orifices and a protection system comprising several add-on sectors assembled around the portion of the tube such that said sectors form a protective envelope surrounding the portion of the tube, each add-on sector being provided with an associated inner stiffener penetrating into the portion of the production tube through at least one through orifice, at least one of the add-on sectors being provided with at least one opening extending through the sector and the associated inner stiffener; said protection system providing the device with resistance to wear by erosion, the device also comprising a sliding sleeve that can be controlled to adjust the flow and wherein each add-on sector comprises several openings with different shapes.

13. A device for control of the flow through a production tube placed in an oil well, the device comprising a portion of the production tube provided with through orifices and a protection system comprising several add-on sectors assembled around the portion of the tube such that said sectors form a protective envelope surrounding the portion of the tube, each add-on sector being provided with an associated inner stiffener penetrating into the portion of the production tube through at least one through orifice, at least one of the add-on sectors being provided with at least one opening extending through the sector and the associated inner stiffener; said protection system providing the device with resistance to wear by erosion, the device also comprising a sliding sleeve that can be controlled to adjust the flow and several sets of sectors, each set having different openings.

* * * * *